US009334767B2

(12) United States Patent
Haefner et al.

(10) Patent No.: US 9,334,767 B2
(45) Date of Patent: May 10, 2016

(54) ROLLER LIFTER LUBRICATION GUIDE

(71) Applicant: Schaeffler Technologies GmbH & Co. KG, Herzogenaurach (DE)

(72) Inventors: Donald Haefner, Troy, MI (US); David Kehr, Oxford, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 29 days.

(21) Appl. No.: 14/546,025

(22) Filed: Nov. 18, 2014

(65) Prior Publication Data

US 2015/0136053 A1 May 21, 2015

Related U.S. Application Data

(60) Provisional application No. 61/906,751, filed on Nov. 20, 2013.

(51) Int. Cl.

| | |
|---|---|
| ***F01M 1/06*** | (2006.01) |
| ***F01M 11/02*** | (2006.01) |
| ***F01L 1/14*** | (2006.01) |
| ***F01M 9/10*** | (2006.01) |

(52) U.S. Cl.

CPC ..... *F01M 11/02* (2013.01); *F01L 1/146* (2013.01); *F01M 9/105* (2013.01); *F01M 9/108* (2013.01); *F01L 2105/00* (2013.01); *F01L 2105/02* (2013.01)

(58) Field of Classification Search

CPC .... F01M 11/02; F01M 9/105; F01M 2105/02
USPC ..... 123/90.35, 90.39, 90.44, 90.48, 90.61
See application file for complete search history.

(56) References Cited

U.S. PATENT DOCUMENTS

| | | | | |
|---|---|---|---|---|
| 5,361,733 | A | 11/1994 | Spath et al. | |
| 6,880,507 | B2 | 4/2005 | Kuhl et al. | |
| 7,363,894 | B2 | 4/2008 | Evans et al. | |
| 7,637,237 | B2 * | 12/2009 | Evans | F01L 1/146 123/90.16 |

* cited by examiner

*Primary Examiner* — Ching Chang
(74) *Attorney, Agent, or Firm* — Antun M. Peakovic

(57) ABSTRACT

A roller lifter or hydraulic roller lifter, including a lifter body, a roller, axle, internal piston assembly and a lubrication guide depression at a lower wall of the lifter body to direct lubricant to the roller and roller axle.

14 Claims, 8 Drawing Sheets

ROLLER LIFTER LUBRICATION GUIDE

The present disclosure relates to barrel or roller lifters for a valve train of an internal combustion engine. In particular, the present disclosure relates to lubrication of rollers and axles for roller lifters.

BACKGROUND

U.S. Pat. No. 6,880,507 discloses valve lift devices, in particular, roller lifters, for example, the previously known lifter at FIG. 2. U.S. Pat. No. 7,363,894 also discloses roller lifters.

Valvetrain components, such as roller lifters, in medium to heavy-duty engines have generally used a roller axle, often comprising a bronze pin supporting plain bearings. This is necessary to carry the heavy loads in a size efficient package. For such designs, lubrication of the roller axle to plain bearing contact area is necessary to reduce friction and wear.

SUMMARY

Certain terminology is used in the following description for convenience and descriptive purposes only, and is not intended to be limiting to the scope of the claims. The terminology includes the words specifically noted, derivatives thereof and words of similar import. According to example aspects illustrated herein, a roller lifter is provided, wherein an oil gallery intersects the lifter bore such that oil is available at the outer radial surface of the lifter body. According to example aspects illustrated herein, there is provided a roller lifter including: a hollow cylindrical lifter body including with a push rod contact surface arranged to contact a push rod at an upper axial end of the lifter body, a lower axial wall, two radially opposed struts extending axially from the lower axial wall, an internal cavity, and a hydraulic piston assembly within the cavity; a cylindrical roller having a through bore; a support axle extending at least partially through the strut axle supports and through the roller through bore; an external port located at an outer radial surface of the lifter body, proximate the lower axial wall, the external port extending through the lifter body to an internal port in the lower axial wall; and, at least one depression proximate the opening in the lower axial wall, the depression directed toward at least one strut.

By providing a port at an outer radial surface of the lifter body that would intersect this gallery at or near to full valve lift, parasitic loss of oil is limited and the oil port directs oil to the roller and axle.

BRIEF DESCRIPTION OF THE DRAWINGS

The above mentioned and other features and advantages of the embodiments described herein, and the manner of attaining them, will become apparent and be better understood by reference to the following description of at least one example embodiment in conjunction with the accompanying drawings. A brief description of those drawings now follows.

DETAILED DESCRIPTION

Identically labeled elements appearing in different ones of the figures refer to the same elements but may not be referenced in the description for all figures. The exemplification set out herein illustrates at least one embodiment, in at least one form, and such exemplification is not to be construed as limiting the scope of the claims in any manner.

Figure 1:
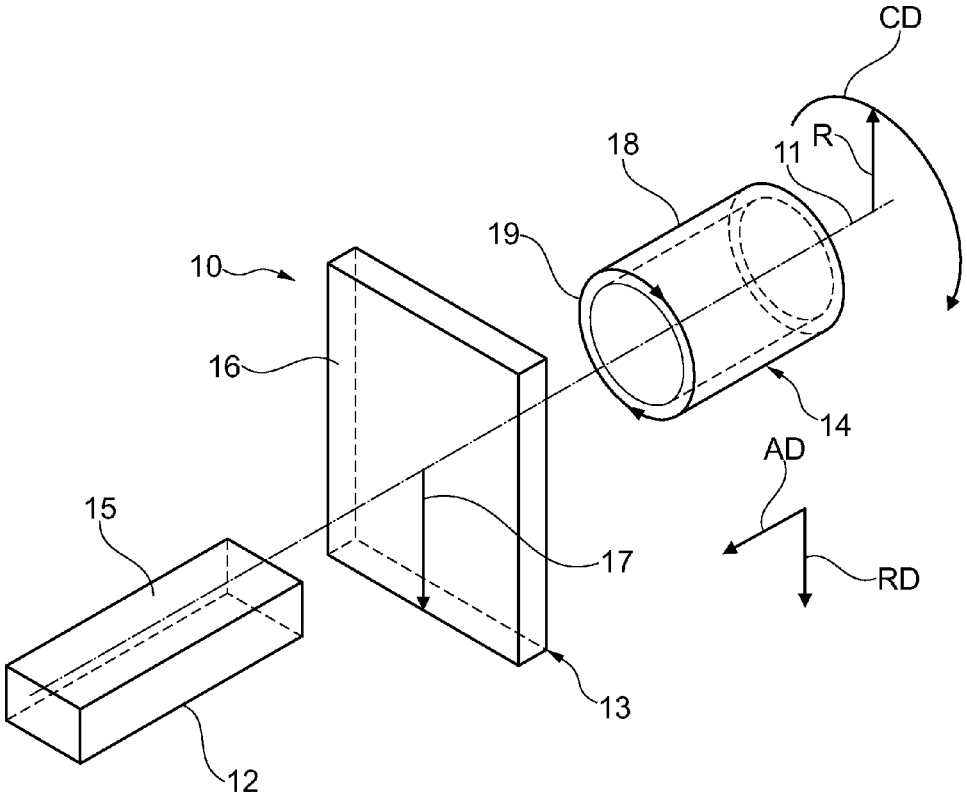
FIG. 1 is a perspective view of a cylindrical coordinate system demonstrating spatial terminology used in the present application.

FIG. 1 is a perspective view of cylindrical coordinate system 10 demonstrating spatial terminology used in the present application. The present application is at least partially described within the context of a cylindrical coordinate system. System 10 includes longitudinal axis 11, used as the reference for the directional and spatial terms that follow. Axial direction AD is parallel to axis 11. Radial direction RD is orthogonal to axis 11. Circumferential direction CD is defined by an endpoint of radius R (orthogonal to axis 11) rotated about axis 11.

To clarify the spatial terminology, objects 12, 13, and 14 are used. An axial surface, such as surface 15 of object 12, is formed by a plane co-planar with axis 11. Axis 11 passes through planar surface 15; however any planar surface co-planar with axis 11 is an axial surface. A radial surface, such as surface 16 of object 13, is formed by a plane orthogonal to axis 11 and co-planar with a radius, for example, radius 17. Radius 17 passes through planar surface 16; however any planar surface co-planar with radius 17 is a radial surface. Surface 18 of object 14 forms a circumferential, or cylindrical, surface. For example, circumference 19 passes through surface 18. As a further example, axial movement is parallel to axis 11, radial movement is orthogonal to axis 11, and circumferential movement is parallel to circumference 19. Rotational movement is with respect to axis 11. The adverbs "axially," "radially," and "circumferentially" refer to orientations parallel to axis 11, radius 17, and circumference 19, respectively. For example, an axially disposed surface or edge extends in direction AD, a radially disposed surface or edge extends in direction R, and a circumferentially disposed surface or edge extends in direction CD.

Figure 8:
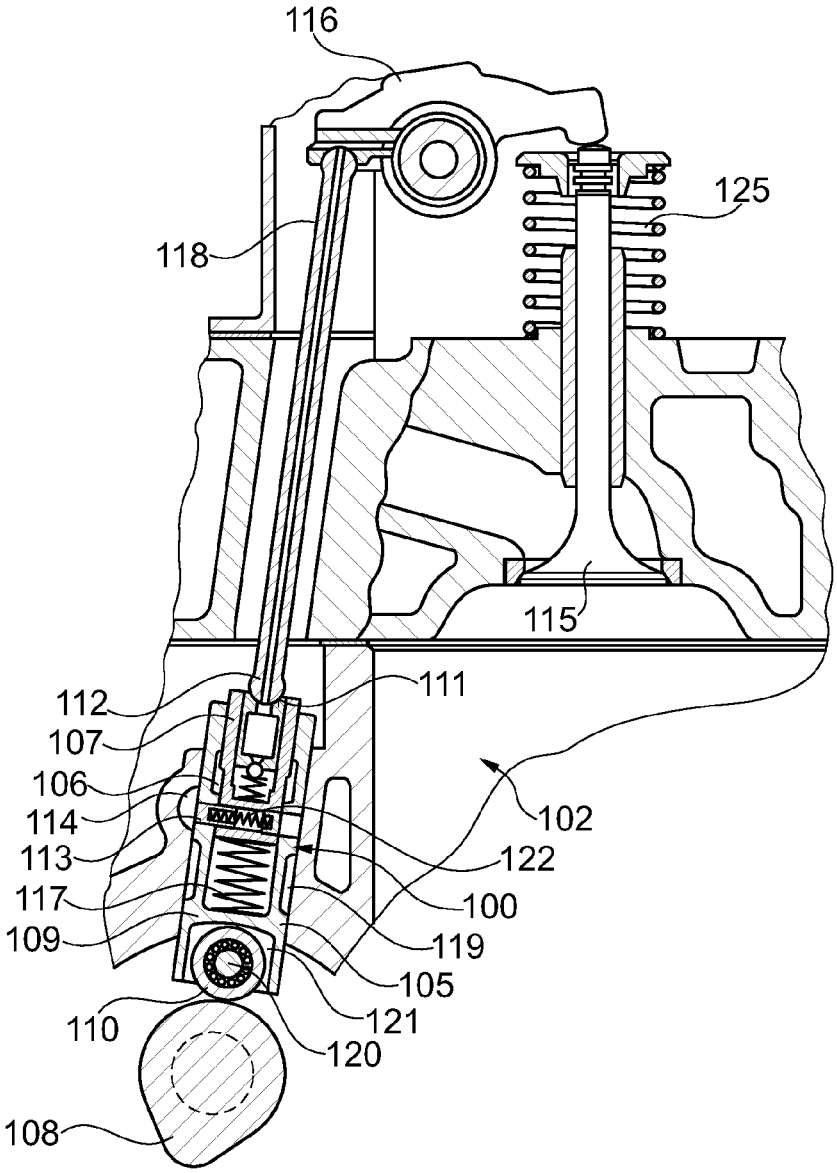
Fig. 8 PRIOR ART
FIG. 8 is a previously known roller lifter assembly, including an associated push rod and valve.

Prior art roller lifter assembly 100 shown in FIG. 8 is installed in valve train 102 of an internal combustion engine (not shown). Roller lifter 100 includes a cylindrical lifter body 105, enclosing an inner cavity 106 and an inner cylindrical body 107. Body 107 can move axially relative to body 105. Lifter body 105 has a lower axial wall 109. Adjacent lower axial wall 109 is assembled a roller 110, in contact with an associated cam lobe 108 of a cam. Roller 110 is shown as a roller bearing supported by a pin or axle 120, pin or axle 120, in turn supported in struts 121 extending axially downward from lifter body 105 and lower axial wall 109. Although roller 110 is shown as a roller bearing it is known in the art that this can be a plain bearing.

Inner cylindrical body 107 contacts pushrod 118 at pushrod end 112 at an upper axial end 111 of body 107, opposite roller 110. Lifter 100 is shown as a lash adjusting element. Oil channel 114 in valve train 102 provides oil supply to an external surface of lifter 100. If switching off of valve 115 is desired, oil is supplied to locking pin 113 in sufficient pressure such that locking pin 113 is displaced against the force of associated compression spring 121 in the radial direction, retracting into body 107. As a result of locking pin 113 retracting, lifter body 105 and inner body 107 are no longer locked in relative position and body 107 can move relative to body 105. During the next cam strokes outer body 105 is shifted relative to inner body 107, with body 107 engaging in lost motion movement against spring 117 located between bodies 105 and 107 in an inner cavity of body 105. Push rod 118 and associated valve 115 are not displaced because the force of compression spring 117 is smaller than the opposing force of valve spring 125.

Figure 2:
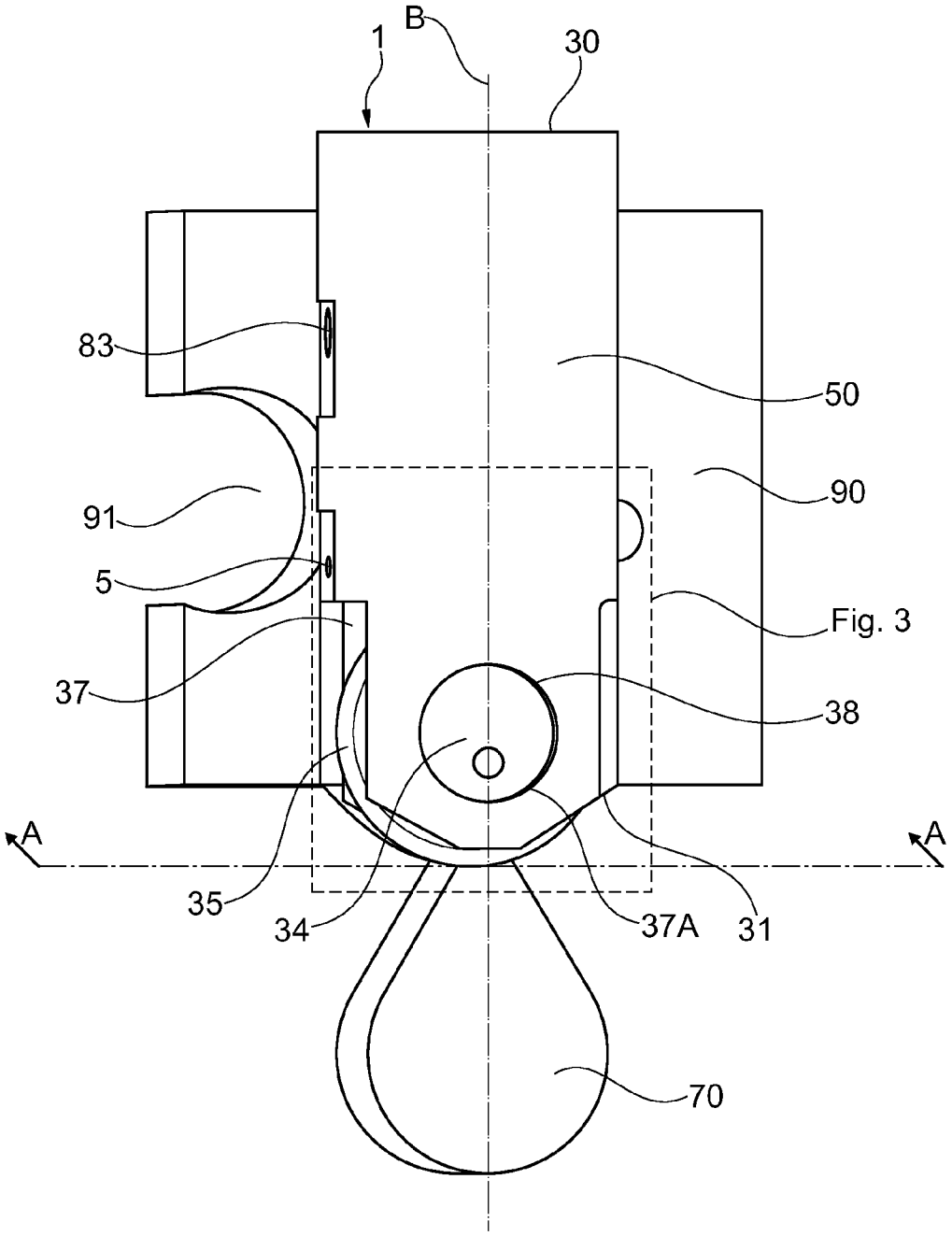
FIG. 2 is a perspective view of a roller lifter in a partial guide bore, according to one embodiment.
Figure 3:
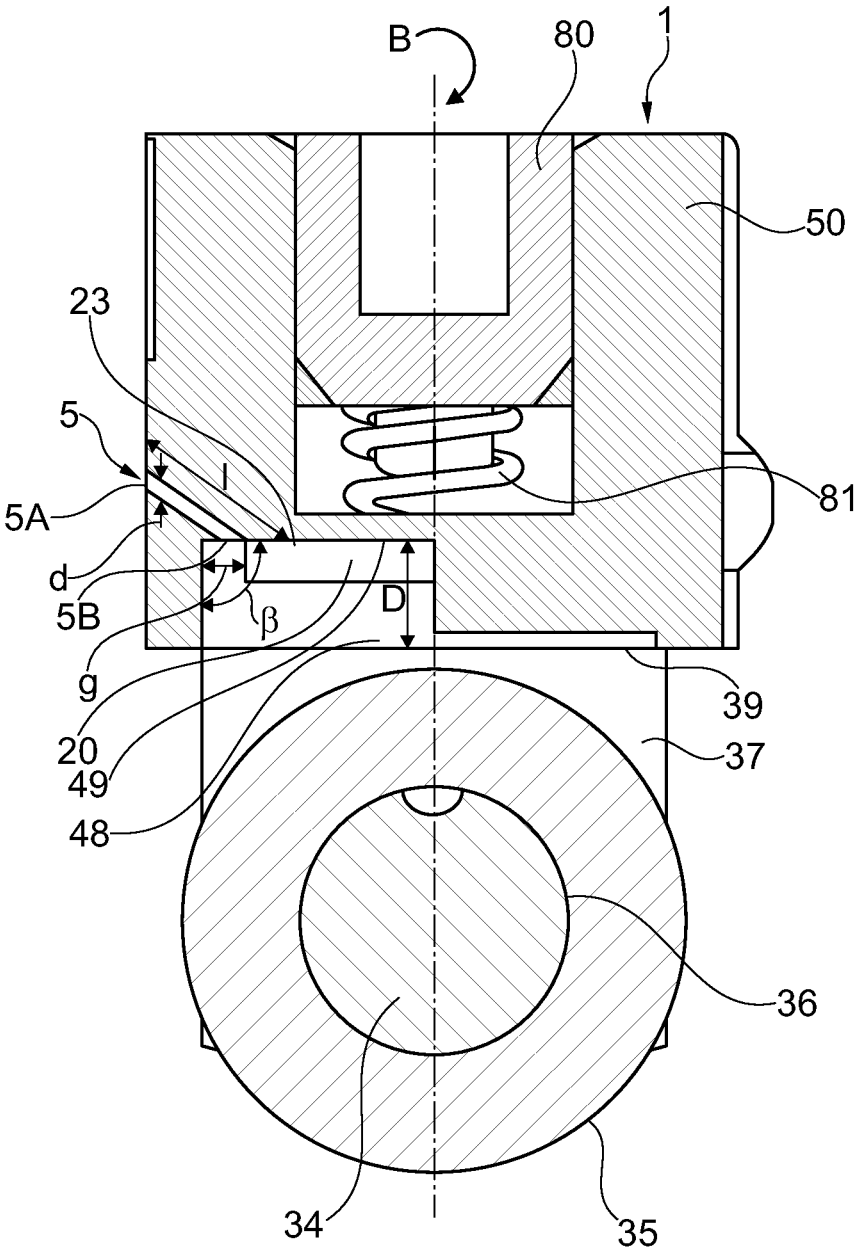
FIG. 3 is an enlarged partial cross sectional view of the roller lifter of FIG. 2, taken along line A-A.
Figure 4:
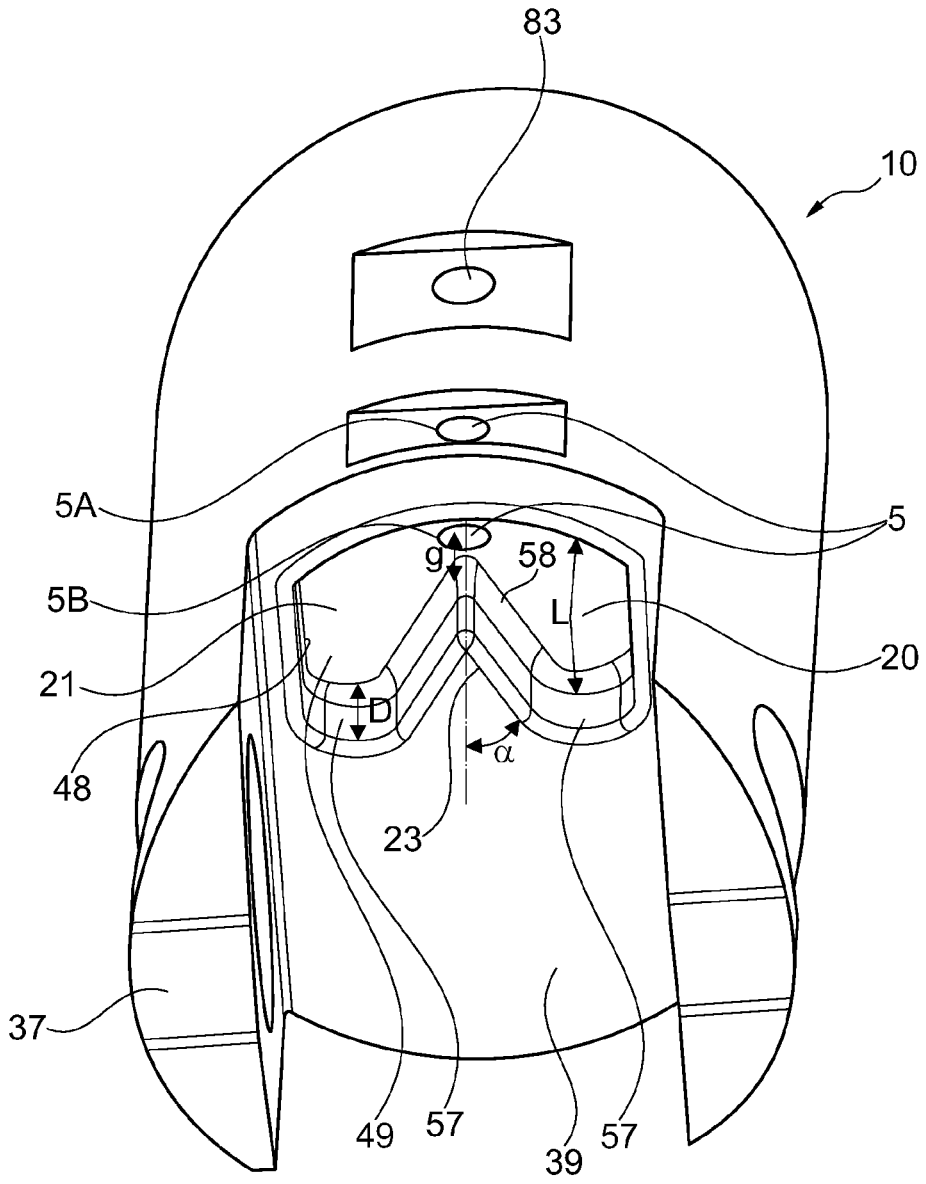
FIG. 4 is a perspective bottom view of the lifter body of the roller lifter of FIG. 1.
Figure 5:
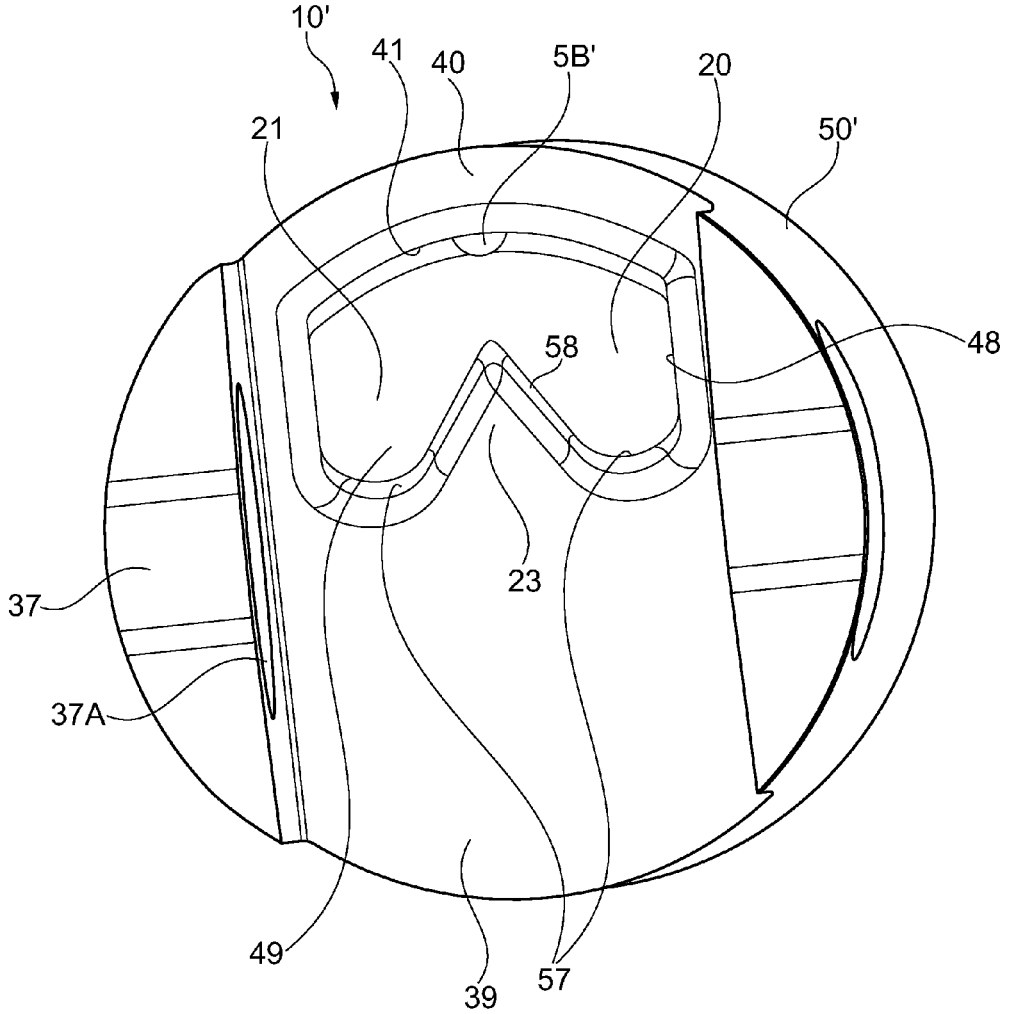
FIG. 5 is a bottom view of the lifter body of the roller lifter of FIG. 1.
Figure 6:
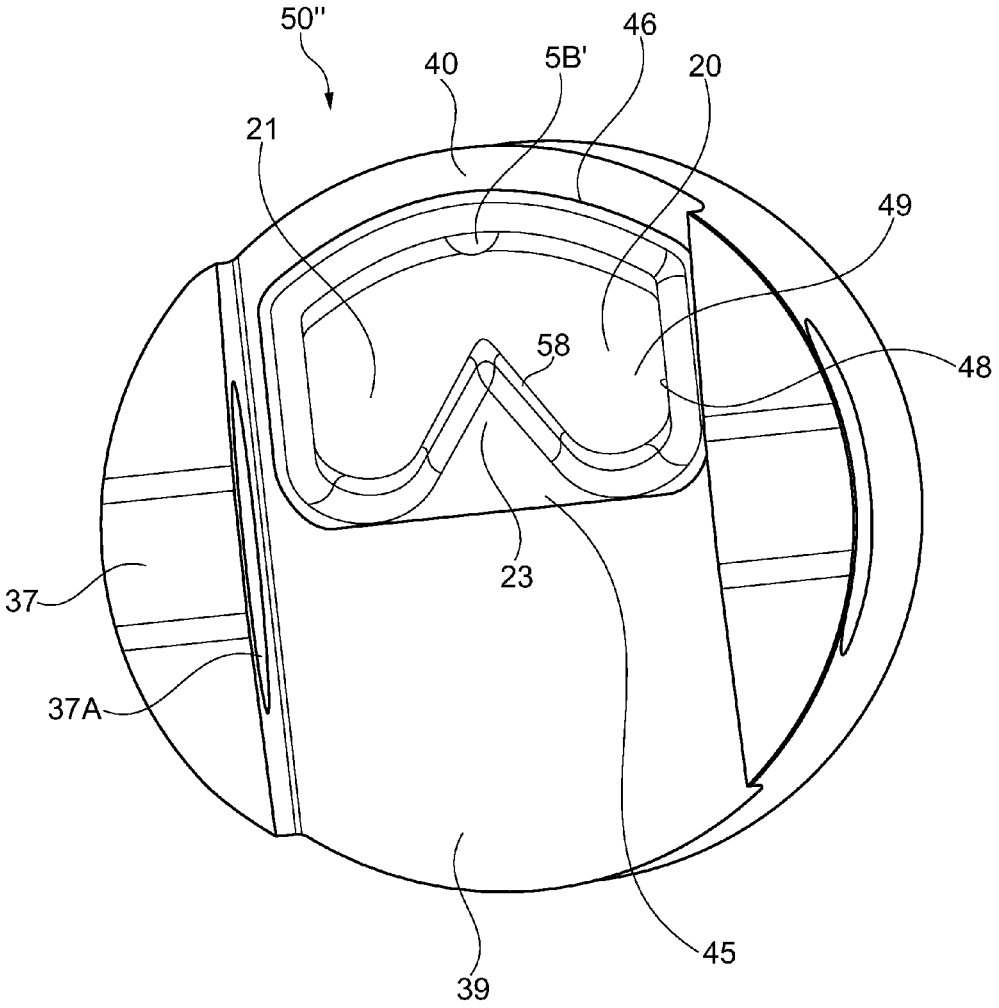
FIG. 6 is a bottom view of a second embodiment of the lifter body of the roller lifter of FIG. 1.
Figure 7:
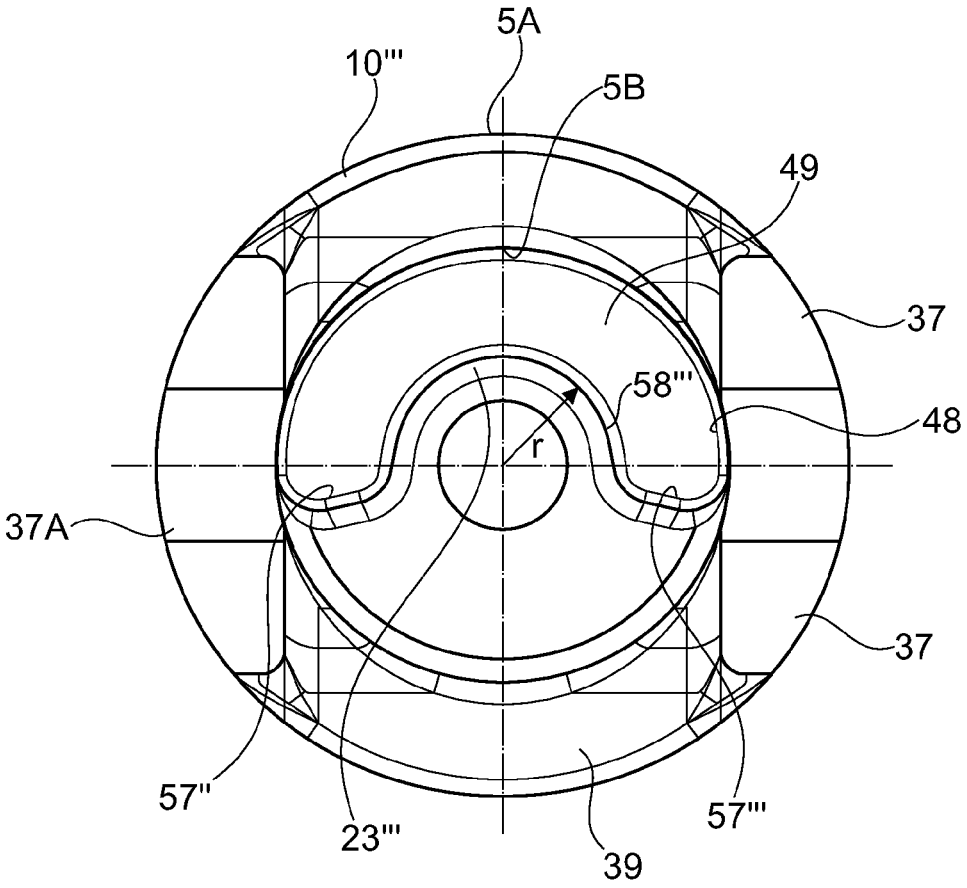
FIG. 7 is a bottom view of a third embodiment of the lifter body of the roller lifter of FIG. 1.

FIG. 2 is a perspective view of roller lifter 1 according to one example embodiment illustrated herein, assembled into cylinder head 90 of an associated internal combustion engine (not shown) with cam lobe 70 of associated camshaft (not shown) in full valve lift operating position. Roller lifter 1 can operate similarly to prior art hydraulic lifter 100 described in FIG. 8, but, it will be understood by one skilled in the art that a mechanical lifter or other type of lifter can be used where an oil gallery can be made available. FIG. 3 is an enlarged cross sectional view of roller lifter 1 of FIG. 2, taken along line A-A. FIG. 4 is a perspective bottom view of outer cylindrical roller lifter body 50 of FIG. 2, according to one example embodiment. FIG. 5 is a bottom view of roller lifter body 10', showing a second example embodiment. FIG. 6 is a bottom view of roller lifter body 10", showing a third example embodiment. FIG. 7 is a bottom view of roller lifter body 10''', showing a fourth example embodiment. The following description should be viewed with regard to FIGS. 1 through 7. Hydraulic roller lifter 1 includes: outer cylindrical lifter body 50 having central axis B, upper axial push rod contact end 30, roller end 31, lower axial wall 39 and axle supports 37 extending axially downward from lifter body 50 and wall 39; inner cylindrical body 80; return or lost motion spring 81; and axle 34 supporting roller 35 between supports 37. Lifter body may be formed in any way known in the art, for example cold forming. In this example embodiment, outer lifter body 50 has axle supports, formed as struts extending axially downward parallel to axis B with perforations 37A to support roller axle 34 and roller 35 thereon. Cylinder head 90 includes oil gallery 91 to supply hydraulic fluid to the internal hydraulic chamber of lifter 1, through supply port 83. As associated cam shaft (not shown) rotates, cam lobe 70 contacts and displaces roller 35 and axle 34 axially upward and, in turn, lifter body 50 upward, allowing oil port 5 to come into fluid communication with oil gallery 91. Port 5 has a diameter d and length l, designed to achieve a particular flow rate. Lubricating fluid, typically engine oil, enters port 5 at entry or external port 5A and exits at exit or internal port 5B. Port 5B is located within depressions 20, 21, on a horizontal surface 49 parallel with lower axial wall 39 of lifter body 50. Oil flows along surface 49 and is guided by contour 23 along surface 58 into depressions 20,21 until oil encounters end or walls 57 and drips or flows down onto roller axle 34. In an alternative embodiment, shown in FIG. 5, port 5B' is shown as extending through radial wall 40 of lifter body 50' and opening in a side surface 41 opposite guide contour 23. Side surface 41 may also be angled upward, such that oil exiting exit port 5B' directs oil upward either toward surface 49 or sprays oil towards contour 23. As oil exits port 5B, it is directed along guide contour 23, in particular, guide contour wall or surface 58, and to depressions 20, 21 from where it can drip or flow down to roller 35 and roller axle 34, lubricating the outer surface of axle 34, as well as roller and axle interface contact surface 36 and axle and support contact surface 38. In the example embodiment in FIGS. 4 and 5, guide contour 23 is shown as a v-shape. However, contour 23 may be a variety of shapes, including an arched or rounded contour, such as contour 23''' in FIG. 7. In addition, depressions 20, 21 and guide contour 23 may be separately formed as a single lubrication guide insert 45 and press fit or otherwise inserted and secured into an appropriately sized insert depression 46 in lower axial wall 39 of lifter body 50".

Depressions 20,21 and guide contour 23 may be varied in depth D, length L and angle of deflection α of contour 23 to direct lubricating oil to different areas of roller 35 and axle 34.

In addition, the desired flow rate of lubricating oil may be achieved by adjusting the diameter of port 5, the depth D of depressions 20,21, the angle α of guide contour walls 23 or radius r in contour 23''' shown in the embodiment of FIG. 7, the distance q from port 5B to guide contour 23 and the angle β of depression upper axial wall 49 adjacent exit port 5B relative to the horizontal plane. Depression wall 49 is shown as horizontal in FIG. 3, however, it is contemplated that various angles β may be used, generally directing oil from port 5B toward depressions 20,21. Upper axial wall 49 can have an angle greater than 0 degrees directed toward the end walls 57.

In this way, impingement of the oil jet or spray from port 5B on either contour 23 (and the other embodiments of the contour, for example 23''') or walls 48, 57 of depressions 20,21 causes oil to mainly flow across guide contour surface 58 and wall 49 to depressions 20,21 before dripping down to roller axle 34, roller 35 and roller axle interface surface 36.

In the foregoing description, example embodiments are described. The specification and drawings are accordingly to be regarded in an illustrative rather than in a restrictive sense. It will, however, be evident that various modifications and changes may be made thereto, without departing from the broader spirit and scope of the present invention.

In addition, it should be understood that the figures illustrated in the attachments, which highlight the functionality and advantages of the example embodiments, are presented for example purposes only. The architecture or construction of example embodiments described herein is sufficiently flexible and configurable, such that it may be utilized (and navigated) in ways other than that shown in the accompanying figures.

Although example embodiments have been described herein, many additional modifications and variations would be apparent to those skilled in the art. It is therefore to be understood that this invention may be practiced otherwise than as specifically described. Thus, the present example embodiments should be considered in all respects as illustrative and not restrictive.

What we claim is:

1. A roller lifter for a valvetrain of an internal combustion engine comprising:

a hollow cylindrical lifter body including:

a push rod contact surface arranged to contact a push rod at an upper axial end of the hollow cylinder lifter body;

a lower axial wall;

two radially opposed struts extending axially from the lower axial wall; and, the two radially opposed struts having radial axle supports;

a cylindrical roller having a through bore;

a support axle extending at least partially through the two radially opposed struts radial axle supports and through the roller through bore to support the roller between the two radially opposed struts;

an external port located at an outer radial surface of the hollow cylindrical lifter body arranged to receive a lubricant, the external port extending through the hollow cylindrical lifter body to direct lubricant to an internal port in the lower axial wall; and, at least one depression in the lower axial wall proximate the internal port to direct the lubricant from the internal port towards the two radially opposed struts and support axle.

2. The roller lifter of claim 1, wherein the at least one depression includes two depressions with one depression directed to each of the two radially opposed struts.

3. The roller lifter of claim 2, wherein the two depressions are separated by a v-shaped contour in the lower axial wall.

4. The roller lifter of claim 3, wherein the depressions are formed by an upper axial wall, side walls and an end wall.

5. The roller lifter of claim 4, wherein the upper axial wall of the depression is at an angle greater than 0 degrees from the internal port to the contour in the lower axial wall.

6. The roller lifter of claim 2, wherein the two depressions are separated by a arched contour in the lower axial wall.

7. The roller lifter of claim 1, wherein the depression is a crescent shape, extending to outer radial peripheries of the lower axial wall of the hollow cylindrical lifter body proximate the two radially opposed struts.

8. The roller lifter of claim 1, wherein a separately formed lubrication guide insert is pressed into an insert depression in the lower axial wall of the hollow cylindrical lifter body.

9. The roller lifter of claim 1, wherein the upper axial wall of the depression is at an angle greater than 0 degrees from the internal port to the contour in the lower axial wall.

10. A roller lifter for a valvetrain of an internal combustion engine comprising:

a hollow cylindrical lifter body including:

a push rod contact surface arranged to contact a push rod at an upper axial end of the lifter body;

a lower axial wall;

two radially opposed struts extending axially from the lower axial wall; and, the two radially opposed struts having radial axle supports;

a cylindrical roller having a through bore;

a support axle extending at least partially through the two radially opposed struts radial axle supports and through the roller through bore to support the roller between the two radially opposed struts;

an external port located at an outer radial surface of the lifter body arranged to receive a lubricant, the external port extending through the lifter body to direct lubricant to an internal port in the lower axial wall;

two depressions each with an upper axial wall proximate the internal port in the lower axial wall, side walls and an end wall to direct the lubricant from the internal port towards the struts and support axle; and, the two depressions separated by a contour in the lower axial wall.

11. The roller lifter of claim 10, wherein the contour is v-shaped.

12. The roller lifter of claim 10, wherein the contour is a circular or arched shape.

13. The roller lifter of claim 10, wherein the contour is directed toward the internal port in the lower axial wall.

14. The roller lifter of claim 10, wherein a separately formed lubrication guide insert is pressed into an insert depression in the lower axial wall of the hollow cylindrical lifter body.

* * * * *